United States Patent [19]

Young, Sr. et al.

[11] 4,197,729

[45] Apr. 15, 1980

[54] HOLD DOWN ROLL ASSEMBLY FOR ALIGNING LONGITUDINAL TUBULAR EDGES IN A TUBE FORMING APPARATUS

[75] Inventors: John L. Young, Sr., Perrysburg; Richard L. Dreier, Northwood, both of Ohio

[73] Assignee: Abbey Etna Machine Company, Inc., Perrysburg, Ohio

[21] Appl. No.: 938,989

[22] Filed: Sep. 1, 1978

[51] Int. Cl.[2] ..... B21D 5/12; B21D 39/02

[52] U.S. Cl. ..... 72/52; 72/181; 228/49 C

[58] Field of Search ..... 72/51, 52, 178, 179, 72/181, 182, 368; 228/17, 17.5, 49, 146, 147, 150, 151

[56] References Cited

U.S. PATENT DOCUMENTS

| | | | |
|---|---|---|---|
| 2,911,932 | 11/1959 | Kinkead | 72/52 |
| 2,970,203 | 1/1961 | Sanner et al. | 219/59 |
| 3,170,427 | 2/1965 | Ruple et al. | 228/49 |
| 3,245,242 | 4/1966 | Maier | 72/52 |
| 3,266,703 | 8/1966 | Ruple | 228/49 |
| 3,301,455 | 1/1967 | Gibson | 226/17 |
| 3,430,475 | 3/1969 | Lindmark | 72/179 |
| 3,752,377 | 4/1973 | Knapp | 226/17 |
| 4,122,696 | 10/1978 | Midzutani et al. | 72/52 |

*Primary Examiner*—Ervin M. Combs
*Attorney, Agent, or Firm*—Wilson, Fraser, Barker & Clemens

[57] ABSTRACT

An assembly for maintaining alignment of a metal strip between successive roll forming means in an apparatus for forming a metal tube is disclosed. The apparatus includes a first set of roll forming means, which form the flat strip of metal into a generally U-shaped cross-sectional configuration, and a second set of roll forming means which form the U-shaped strip into a generally annular cross-sectional configuration. The assembly includes a pair of cylindrical hold down rolls which engage the guide respective marginal edge portions of the U-shaped strip into the second set of roll forming means. The cylindrical hold down rolls are rotatably supported by appropriate shaft means. The end portions of each of the shaft means are supported by vertically adjustable bearing means for adjusting the angular disposition of the shaft and the associated cylindrical hold down roll with respect to the marginal edge portions of the formed strip of metal. Since the distance between each cooperating pair of bearing means changes during the angular disposition of the shaft, at least one end of the bearing means must allow the shaft to slide telescopically therein when the angular disposition of the shaft is changed.

3 Claims, 3 Drawing Figures

HOLD DOWN ROLL ASSEMBLY FOR ALIGNING LONGITUDINAL TUBULAR EDGES IN A TUBE FORMING APPARATUS

BACKGROUND OF THE INVENTION

1. Field of the Invention

The present invention relates to an assembly for maintaining alignment of a metal strip within a tube forming apparatus. The forming process is typically performed by a first set of roll forming means which form the initially flat strip of metal into a generally U-shaped cross-sectional configuration and a second set of roll forming means which form the U-shaped strip into a generally annular cross-sectional configuration. The marginal edge portions of the formed strip are thus adjacent each other and are welded together by a suitable welding means to form a tube.

Metal tubes formed in the above described manner are often used for transferring high pressure fluids. A failure in such a tube could lead to undesirable and serious consequences. Therefore, an integral weld of the abutting marginal edges of the formed tube is of utmost importance. To insure a proper weld, the marginal edge portions of the formed strip must be continuously in aligned contact with each other. In order to obtain the desired degree of weld integrity, the formed strip must maintain a consistently straight linear extension coinciding with its longitudinal axis. It has been found in practice, however, that the marginal edge portions of the metal strips to be formed are not always parallel to the longitudinal axis of the strip. Therefore, the strip may tend to twist helically when subjected to the roll forming process. Thus, in the apparatuses of the prior art, the marginal edge portions at the trailing end of a formed strip may not be longitudinally aligned after the forward end of the formed strip is introduced into the second set of roll forming means. If improperly aligned, the marginal edge portions of the formed strip will not be formed adjacent one another, a configuration necessary for a secure weld. The result thereof is a deficient tube having a faulty and unreliable seam weld.

2. Description of the Prior Art

One attempt to solve the alignment problem is disclosed in U.S. Pat. No. 3,430,475, issued to B. M. Lindmark. Angularly disposed guide rolls are employed in paired relation within the interior of the formed strip to guide the marginal edges thereof. The guide rolls are shaped generally as truncated cones and are supported on non-adjustable shafts extending through a gap between the marginal edge portions of the formed strip.

Another attempt to solve the alignment problem is disclosed in U.S. Pat. No. 3,170,427, issued to L. H. Ruple et al. Tube edge guide devices are interposed between the roll stands of a roll forming means. The guide devices include a plurality of closely spaced rollers which occupy substantially the entire space between adjacent roll stands so as to engage and guide the marginal edge portions of a formed strip to prevent distortion or buckling action.

In U.S. Pat. No. 2,970,203, issued to Sanner et al, a universally adjustable guide plate depends from a supporting assembly into the space between the marginal edge portions of a formed strip so as to effect the proper spacing of the marginal edge portions and guide the edge portions into a welding assembly.

SUMMARY OF THE INVENTION

In the manufacture of metal tubes, it is a known practice to utilize strips of metal and roll form them into tubular sections, the longitudinal axis of which coincides with the longitudinal direction of the strip. A strip is initially introduced into a first set of rolling means which forms the strip into a generally U-shaped cross-sectional configuration. The strip is then subjected to a second set of roll forming means which forms the strip into a generally annular cross-sectional configuration. The marginal edge portions of the formed strip can then be welded together by suitable welding means to form a tube. Since the marginal edge portions of the formed strip are not always perfectly parallel to the longitudinal axis thereof, the strip may tend to twist helically between the first and second set of roll forming means. Therefore, it is desirable to provide an assembly for aligning the marginal edge portions of the formed strip between successive roll forming operations prior to the introduction thereof to the welding means.

The assembly of the present invention includes a pair of cylindrical hold down rolls, each of which is supported by a cooperating supporting shaft. As a formed strip emerges from the first set of roll forming means, the hold down rolls engage and maintain alignment of the respective marginal edge portions of the formed strip prior to its introduction into the second set of roll forming means. The ends of the supporting shafts of the hold down rolls are journalled by suitable bearing supports mounted on stanchions such that the bearing supports can be selectively vertically adjusted. By varying the vertical adjustment of the bearing supports, the angular disposition of the supporting shafts and the associated hold down rolls can be readily adjusted to conform to the marginal edge portions of a formed strip. Since the distance between a cooperating pair of bearing supports changes with the angular disposition of the supporting shaft, at least one end of each shaft must be able to slide telescopically through the associated bearing support.

It is an object of the present invention to increase the efficiency and reduce the cost of manufacturing metal tubes by providing an assembly for maintaining alignment of a metal strip between successive roll forming operations in a tube forming apparatus.

Another object of the present invention is to provide an aligning assembly which is easily adjustable to adapt to various wall thicknesses and diameters of tube being formed.

A further object of the present invention is to provide an assembly which is compatible with existing machinery designed to form metal tubes.

BRIEF DESCRIPTION OF THE DRAWINGS

Other objects and advantages of the invention will be apparent to those skilled in the art from the following detailed description of the invention when considered in the light of the accompanying drawings, in which.

DETAILED DESCRIPTION OF THE INVENTION

Figure 1:
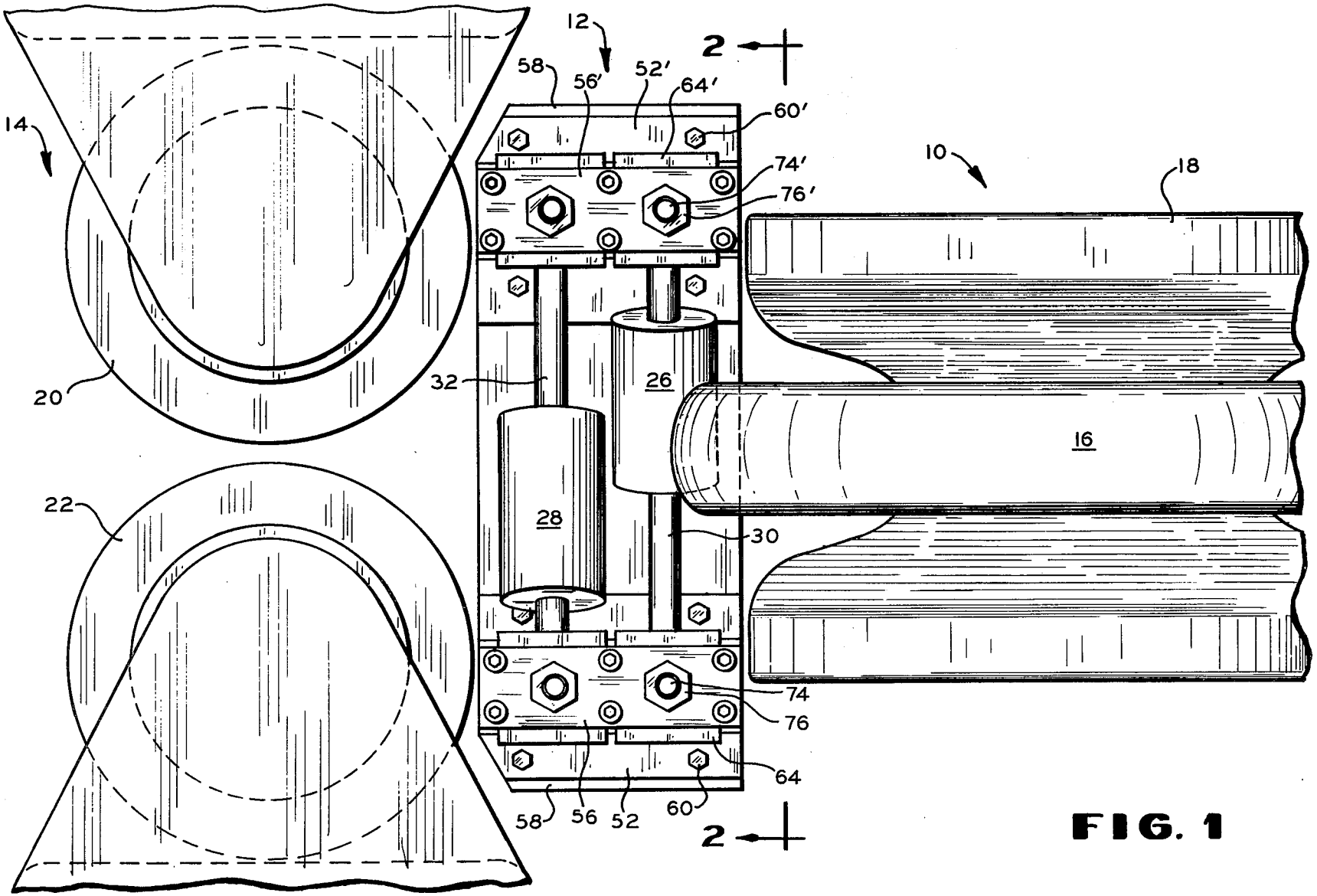
FIG. 1 is a plan view of a portion of a tube forming apparatus illustrating the assembly for maintaining the desired alignment of the marginal edge portions of a formed strip.

Referring to the Figures, there is illustrated a portion of an apparatus for forming a metal tube from a flat metal strip which includes a first set of roll forming means, generally indicated by reference numeral 10; an assembly for maintaining alignment of a metal strip, generally indicated by reference numeral 12; and a second set of roll forming means, generally indicated by reference numeral 14. The first set of roll forming means 10 typically includes a plurality of pairs of cooperating feeding and forming rolls of differing cross-sectional shapes for gradually forming a flat strip of metal into a generally U-shaped cross-sectional configuration. Only the final upper feed roll 16 and the associated lower forming roll 18 are illustrated. The second set of roll forming means 14 includes a plurality of cooperating pairs of cluster rolls of differing cross-sectional shapes for gradually bending a U-shaped strip of metal into a generally annular cross-sectional configuration. Only the initial pair of cooperating cluster rolls 20 and 22 are illustrated. The metal strip, having acquired a generally tubular shape, is then fed from the second set of roll forming means 14 to a welding unit (not shown). The welding unit, such as a high frequency inductive welder, causes the adjacent marginal edge portions of the formed strip to be welded together to form a continuous integral seam. The formed tube is then cut into appropriate lengths for later use by a severing means.

It is desirable in such a tube forming apparatus that the marginal edge portions of the metal strip be aligned adjacent each other so as to assure that a secure weld is produced. To obtain the desired degree of precision, the formed strip must maintain a consistently straight linear extension coinciding with its longitudinal axis. In practice, however, the marginal edge portions of a flat strip are not perfectly parallel to the longitudinal axis of the strip. When a metal strip is being subjected to the stresses applied by the two sets of roll forming means 10 and 14, the strip may tend to twist helically. Thus, the trailing marginal edge portions of the formed strip may not be longitudinally aligned with leading marginal edge portions of the formed strip as the strip is introduced into the second set of roll forming means 14. If improperly aligned, the formed strip will not be properly oriented with respect to the welding unit, which is necessary for obtaining the desired seam weld.

Figure 2:
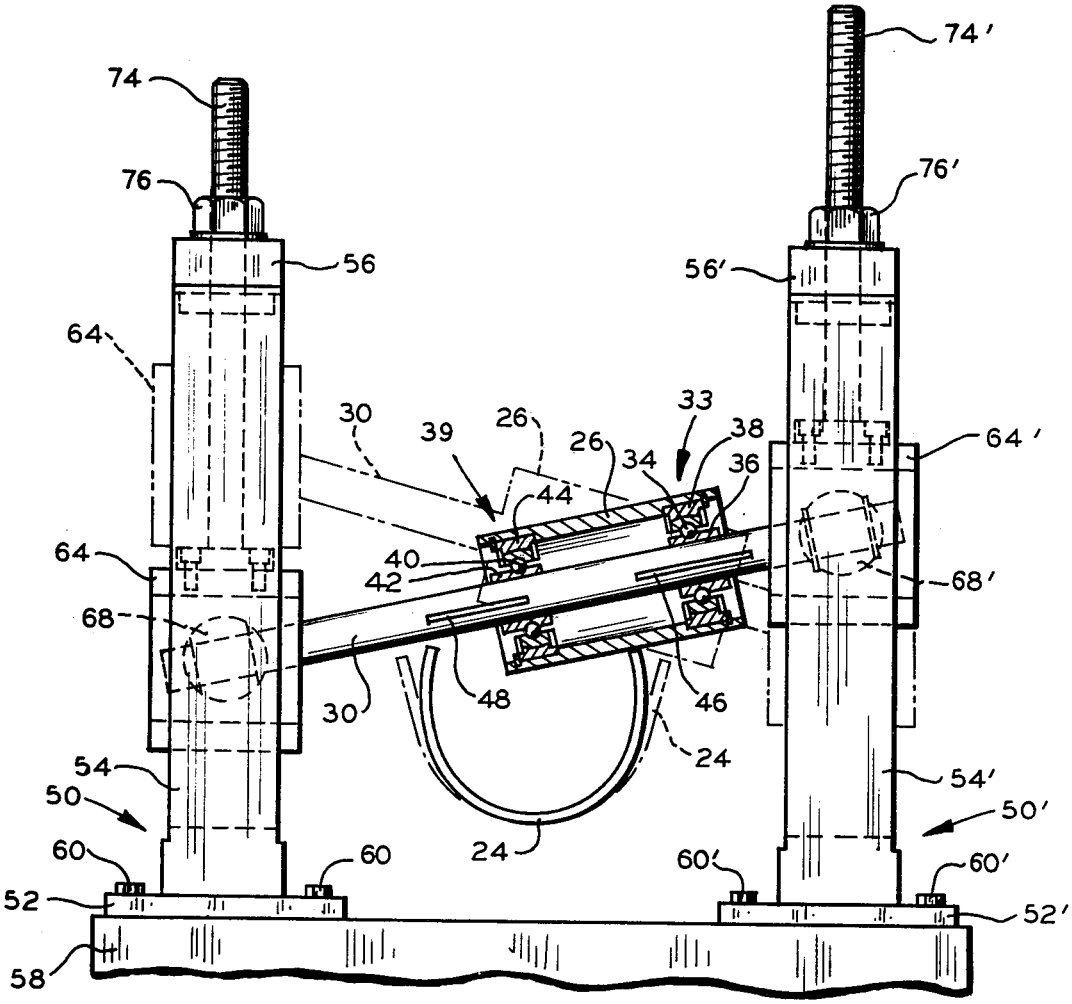
FIG. 2 is a sectional elevational view of the assembly illustrated in FIG. 1 taken along line 2—2 thereof.
Figure 3:
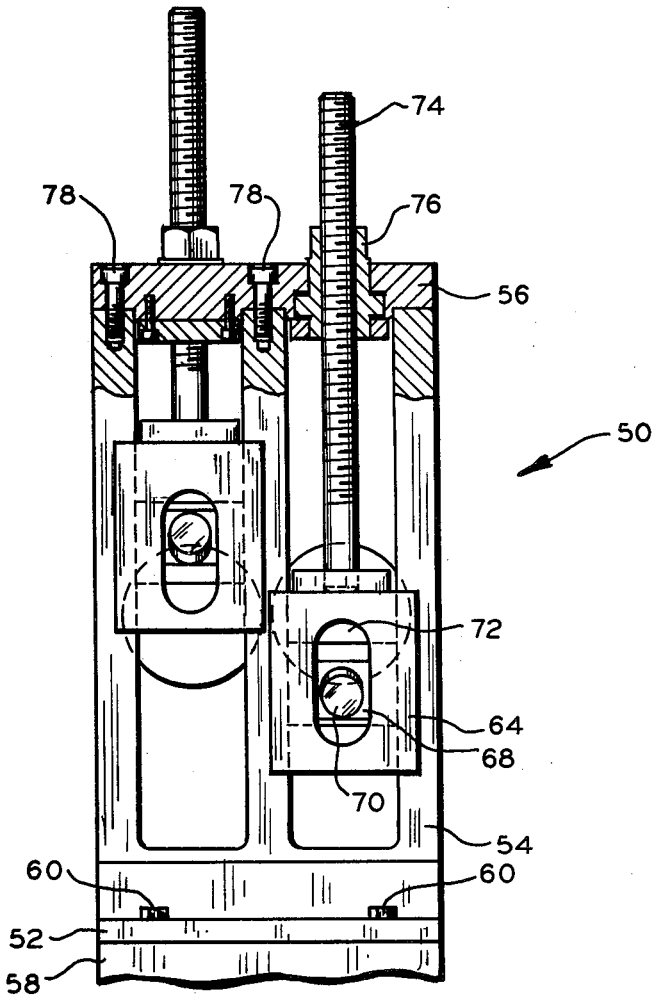
FIG. 3 is a fragmentary side elevational view of the assembly illustrated in FIGS. 1 and 2 with portions cut-away to more clearly illustrate the structure.

The assembly 12 of the present invention is typically interposed between the two sets of roll forming means 10 and 14 to maintain alignment of a U-shaped metal strip 24, as clearly illustrated in FIG. 2. The assembly 12 includes cooperating hold down rolls 26 and 28 for engaging and aligning the marginal edge portions of the metal strip 24 being formed. The hold down rolls 26 and 28 are rotatably supported by respective shafts 30 and 32. Since each of the cooperating hold down rolls 26 and 28 is mounted similarly, reference will be made to only the elements of the hold down roll 26 as illustrated in FIGS. 2 and 3. The shaft 30 which rotatably supports the hold down roll 26 extends outwardly from each side thereof. The hold down roll 26 is rotatably secured at one end to the shaft 30 by a ball bearing assembly, generally indicated by reference numeral 33, which includes a plurality of annularly disposed ball bearings 34 interposed between an inner race 36, the inner surface of which is press fitted to the outer periphery of the shaft 30, and an outer race 38, the outer surface of which is snugly secured with a suitable recess formed in the hold down roll 26. Similarly, a second ball bearing assembly 39 including an annular array of ball bearings 40 interposed between an inner race 42 and an outer race 44 rotatably secure the other end of the hold down roll 26. The ball bearing assemblies 33 and 39 allow the hold down roll 26 to rotate freely about the shaft 30. A positioning assembly may be employed to enable the hold down roll 26 to be slidably adjustable along a portion of the length of the shaft 30. For example, suitable screw assemblies (not shown) may be utilized to respectively engage a keyway 46 formed in the shaft 30 near one end of the hold down roll 26 and a similar keyway 48 formed at the other end of the hold down roll 26. Thus, the roll 26 may be adjusted to any position within the bounds of the keyways 46 and 48. A similar arrangement is formed in the other hold down roll 28 and the associated shaft 32.

It will be appreciated that the hold down roll 26 is effective to engage one marginal edge portion of the metal strip 24 while the other hold down roll 28 is effective to engage the opposite marginal edge portion thereof. Typically, the hold down rolls 26 and 28 are disposed in close proximity of one another and the respective means for adjustable support may be formed as a single unit, as clearly illustrated in FIG. 3. In the illustrated embodiment, a stanchion, generally indicated by reference numeral 50, includes a base 52, a vertically extending support member 54, and an upper plate 56. The base 52 is typically secured to an integral part of the tube forming apparatus frame 58 by any suitable, such as, for example, a plurality of threaded fasteners 60. The support member 54 is provided with an elongate opening therein for receiving a bearing support 64 which is adapted to slide vertically. The bearing support 64 includes a journal member 68 which is mounted within the support 64 to rotate about a generally horizontal axis perpendicular to the longitudinal axis of the shaft 30. The journal member 68 is provided with a bore 70 therethrough for slidably receiving one end of the shaft 30. An elongate aperture 72 is formed in the bearing support 64 to receive the outermost end of the shaft 30 and permit vertical movement thereof during the adjustment procedure to be explained in greater detail hereinafter.

An externally threaded lead screw 74 is suitably attached to the upper portion of the bearing support 64 and extends upwardly therefrom into threaded engagement with a cooperating internally threaded control nut 76 rotatably secured to the upper plate 56 of the stanchion 50. The upper plate 56 is suitably secured to the upper end portion of the support member 54 by a plurality of threaded fasteners 78, for example, as illustrated in FIG. 3. In order to effect vertical movement of the bearing support 64, the threaded control nut 76 is rotated. The rotation of the control nut 76 causes the lead screw 74 to be moved upwardly or downwardly, depending on the direction of the rotation, thereby vertically positioning the bearing support 64 and the angular disposition of the shaft 30 and the associated hold down roll 26.

The opposite end of the shaft 30 is similarly mounted. As illustrated in FIG. 2, a stanchion, generally indicated by reference numeral 50', includes a base 52', a vertically extending support member 54', and an upper plate 56'. The base 52' is typically secured to an integral part of the tube forming apparatus frame 58 by any suitable, such as, for example, a plurality of threaded fasteners 60'. The support member 54' is provided with an elongate opening therein for receiving a bearing support 64' therein which is adapted to slide vertically. The bearing support 64' includes a journal member 68' which is mounted within the support 64' to rotate about a generally horizontal axis perpendicular to the axis of the shaft 30. The journal member 68' is provided with a bore (not shown) therethrough for receiving one end of the shaft 30. The shaft is appropriately secured to the bearing support 64' by, for example, a detent (not shown). An elongate aperture (not shown) is formed in the bearing support 64' to receive the outermost end of the shaft 30 and permit vertical movement thereof during the adjustment procedure to be explained in greater detail hereinafter.

An externally threaded lead screw 74' is suitably attached to the upper portion of the bearing support 64' and extends upwardly therefrom into threaded engagement with a cooperating internally threaded control nut 76' rotatably secured to the upper plate 56' of the stanchion 50'. The upper plate 56' is suitably secured to the upper end portion of the support member 54' by a plurality of threaded fasteners 78', for example, as illustrated in FIG. 3. In order to effect vertical movement of the bearing support 64', the threaded control nut 76' is rotated. The rotation of the control nut 76' causes the lead screw 74' to be moved upwardly, or downwardly, depending on the direction of the rotation, thereby vertically positioning the bearing support 64' and the angular disposition of the shaft 30 and the associated hold down roll 26. Thus, by selectively adjusting the vertical position of the cooperating bearing supports 64 and 64', the angular disposition of the shaft 30 and the associated hold down roll 26 can be varied to conform to the marginal edge portions of any width or thickness of a metal strip 24, as the phantom view clearly illustrates in FIG. 2. Because the distance between a cooperating pair of bearing supports 64 and 64' will vary with the angular disposition of the shaft 30, at least one end of the shaft 30 must be able to slide telescopically through a bearing support 64 or 64'. In the illustrated embodiment, the bearing support 64 slidably supports one end of the shaft 30. The other hold down roll 28 and the associated means for adjustable support are identical to the above described hold down roll 26 and means for adjustable support. In the interest of brevity, therefore, a detailed description of their construction and operation is not presented. In light of the above detailed description, it will be appreciated that the present invention has produced an assembly wherein by relatively simple adjustments, a metal strip being formed can be aligned between successive roll means in an apparatus for forming a metal tube.

In accordance with the provisions of the patent statutes, we have explained the principles and mode of operation of our invention and have illustrated and described what we now consider to represent its best embodiment. However, we desire to have it understood that, within the scope of the claims, the invention may be practiced otherwise than as specifically illustrated and described.

We claim:

1. In an apparatus for forming a tube of predetermined diameter from a continuous flat strip of metal wherein the outermost side edge surfaces of the strip are joined together to form a tube including roll means for supporting the strip along a longitudinal axis thereof, a first set of roll means for forming the flat strip into a generally U-shaped cross-section, a second set of roll means for forming the strip from a U-shaped cross-section into a generally annular cross-section, and an assembly for maintaining alignment of the formed strip disposed between the first set of roll means and the second set of roll means, said assembly comprising:

at least a pair of cooperating roll means for engaging and guiding the outermost side edge surfaces of the formed strip, one of said roll means being positioned to contact one of said side edge surfaces of the strip of metal and another of said roll means being positioned to contact the other of said side edge surfaces of the strip of metal;

means for rotatably supporting each of said roll means to permit each of said roll means to rotate about an axis to establish rolling contact between the outermost side edge surfaces of the strip of metal being formed and the respective one of said roll means; and means for adjustably supporting said rotatably supporting means to selectively adjust the rotational axis of each of said roll means independently of one another to maintain the rolling contact between the outermost side edge surfaces of the strip of metal being formed and the respective one of said roll means and to maintain a parallel relation between the rotational axis of each of said roll means and the respective outermost side edge surface of the strip of metal being formed.

2. The invention defined in claim 1 wherein said means for adjustably supporting each of said cooperating roll means includes a bearing support, a journal member, and a means for effecting vertical adjustment.

3. The invention defined in claim 2 wherein said means for effecting vertical adjustment includes a lead screw and an associated control nut.

* * * * *